US006908043B2

(12) United States Patent
Boecking

(10) Patent No.: US 6,908,043 B2
(45) Date of Patent: Jun. 21, 2005

(54) FUEL INJECTION DEVICE FOR INTERNAL COMBUSTION ENGINES

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 28 days.

(21) Appl. No.: 10/433,429

(22) PCT Filed: Sep. 14, 2002

(86) PCT No.: PCT/DE02/03449

§ 371 (c)(1),
(2), (4) Date: Jun. 4, 2003

(87) PCT Pub. No.: WO03/031802

PCT Pub. Date: Apr. 17, 2003

(65) Prior Publication Data

US 2004/0046061 A1 Mar. 11, 2004

(30) Foreign Application Priority Data

Oct. 4, 2001 (DE) ..... 101 49 004

(51) Int. Cl.[7] ..... F02M 47/02; F02M 59/00; F02M 61/00; F02M 63/00; F02M 39/00

(52) U.S. Cl. ..... 239/88; 239/533.2; 239/533.3; 123/447; 123/467

(58) Field of Search ..... 239/88, 533.2, 239/533.3, 89–96, 533.8, 533.9; 123/447, 467, 446, 477, 478

(56) References Cited

U.S. PATENT DOCUMENTS 4,459,959 A * 7/1984 Terada et al. ..... 123/446
5,826,562 A * 10/1998 Chen et al. ..... 123/446
5,992,359 A * 11/1999 Rose ..... 123/78 E
6,453,875 B1 * 9/2002 Mahr et al. ..... 123/446
6,513,497 B1 * 2/2003 Mahr et al. ..... 123/447

FOREIGN PATENT DOCUMENTS

WO WO 01/52916 A2 * 7/2001

* cited by examiner

*Primary Examiner*—Steven J. Ganey
*Assistant Examiner*—Darren Gorman
(74) *Attorney, Agent, or Firm*—Ronald E. Greigg

(57) ABSTRACT

In a fuel injection system for internal combustion engines including a plurality of injection valves connected to a fuel injection line and each having a nozzle chamber, a control chamber, a valve member controlling injection openings and which is actuatable counter to the action of a closing spring via a first control face acting in the valve opening direction, and via a second control face acting in the valve closing direction, one piston, displaceable in the compression direction, which on its face end defines a first compression chamber, for generating the injection pressure, one first valve for controlling the pressure buildup in the first compression chamber, and one second valve for controlling the pressure buildup in the control chamber. The piston, with an annular shoulder, defines a second compression chamber communicating with the control chamber.

12 Claims, 2 Drawing Sheets

FUEL INJECTION DEVICE FOR INTERNAL COMBUSTION ENGINES

CROSS-REFERENCE TO RELATED APPLICATIONS

This application is a 35 USC 371 application of PCT/DE 02/03449 filed on Sep. 14, 2002.

BACKGROUND OF THE INVENTION

1. Field of the Invention

The invention is directed to an improved fuel injection system including a plurality of injectors for injecting fuel into the cylinders of an internal combustion engine.

2. Description of the Prior Art

In a fuel injection system of illustrated in FIG. 1 of German Patent Disclosure DE 199 39 419 A1, the injection pressure is also used as the control pressure for a control chamber. For a preinjection and a postinjection, a local pressure reservoir is necessary.

SUMMARY OF THE INVENTION

The fuel injection system of the invention has the advantage over the prior art that by means of a stepped piston, the high pressure for the injection and the control pressure for the control chamber are generated separately from one another. As a result, preinjections and/or postinjections that are controllable exactly are possible.

BRIEF DESCRIPTION OF THE DRAWINGS

Two exemplary embodiments of the fuel injection system of the invention are explained in further detail in the ensuing description, taken in conjunction with the drawings, in which.

DESCRIPTION OF THE PREFERRED EMBODIMENTS

Figure 1:
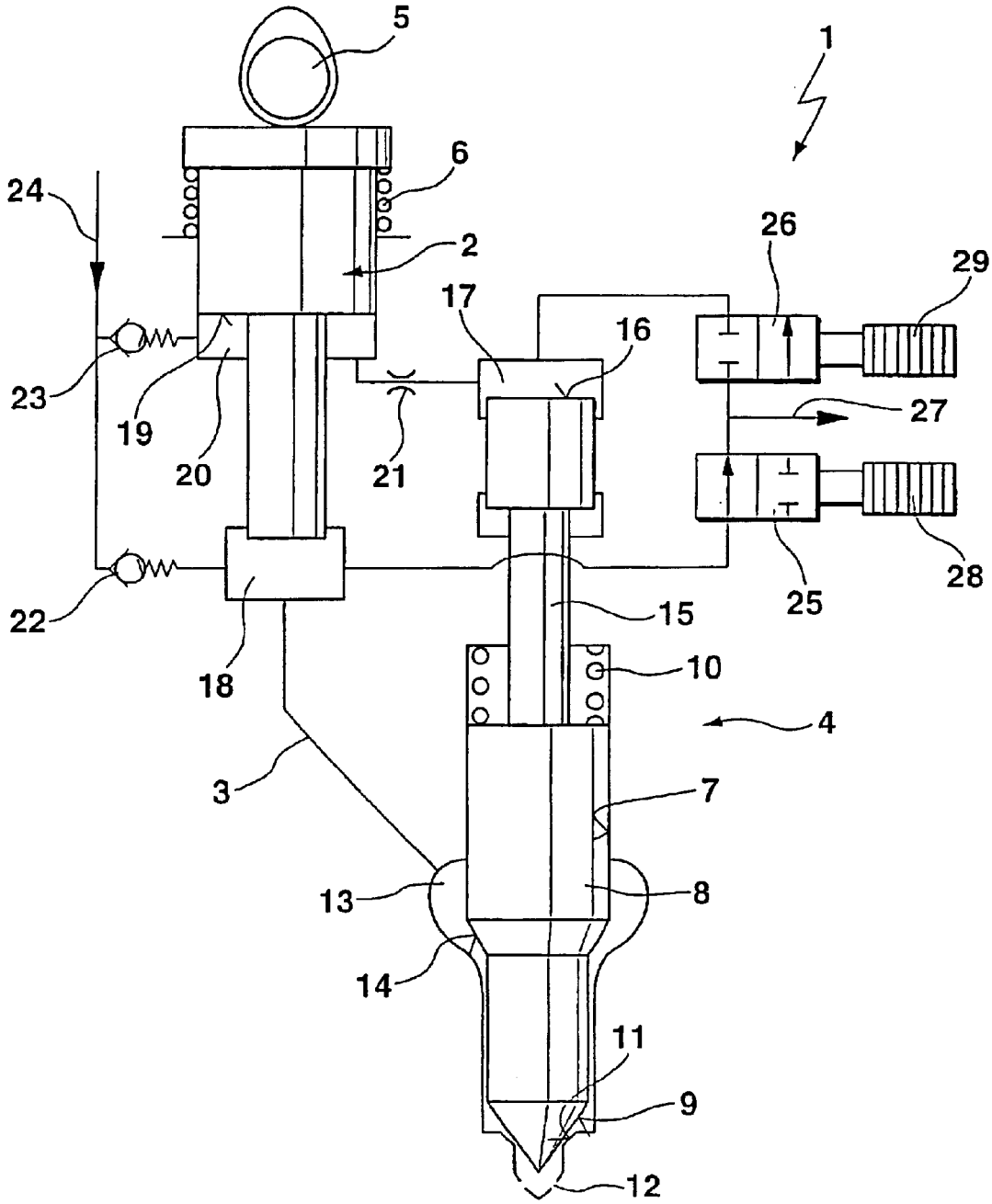
FIG. 1 schematically shows the essential components of a first fuel injection system of the invention, with a graduated pump piston and with a closing piston acting on the valve member.

The fuel injection system shown in FIG. 1 for an internal combustion engine includes a unit injector (UI) 1, in which the fuel is compressed to a higher injection pressure by means of a pump piston 2 and is carried away via an injection line 3 to an injection valve (injector) 4 protruding into the combustion chamber of the engine to be supplied. One unit injector 1 per engine cylinder is built into a cylinder head. The pump piston 2 is driven by a cam 5 of the engine camshaft counter to the action of a restoring spring 6.

In an axial guide bore 7 of the injection valve 4, a pistonlike valve member (nozzle needle) 8 with a conical valve sealing face 9 is displaceably supported; this face is pressed by a closing spring 10 against a conical valve seat face 11 of the valve housing and closes the injection openings 12 provided there. The injection line 3 discharges in the injection valve 4 into an annular nozzle chamber 13, from which an annular gap between the guide bore 7 and the valve member 8 extends as far as the valve seat face 11. In the region of the nozzle chamber 13, the valve member 8 has a first control face 14, embodied as a pressure shoulder, at which the fuel delivered via the injection line 3 engages the valve member 8 in the opening direction (that is, inward). The face end of the valve member 8 remote from the valve sealing face 9 is engaged by a closing piston 15, whose face end remote from the valve sealing face 9 forms a second control face 16. The second control face 16 defines a control chamber 17 and acts in the valve closing direction.

The pump piston 2, with its face end remote from the cam 5, defines a first compression chamber 18 communicating with the injection line 3, and with an annular shoulder 19, it defines a second compression chamber 20, which communicates with the control chamber 17 via a throttle 21. The two compression chambers 18, 20 each communicate via a respective check valve 22, 23 with a supply line 24 for the fuel. The first compression chamber 18, from which the injection line 3 begins, can be made to communicate via a first valve 25, and the control chamber 17 can be made to communicate via a second valve 26, with a relief line (leak fuel) 27. The two valves 25, 26 are embodied as 2/2-way valves with piezoelectric actuators 28, 29. In the first compression chamber 18, the high pressure for the injection is generated, and in the second compression chamber 20, the high pressure for the control function of the control chamber 17 is generated. The second control face 16 is larger than the first control face 14, so that when the valves 25, 26 are closed and there is an identical high pressure in the nozzle chamber 13 and in the control chamber 17, the valve member 8 closes the injection openings 12.

During the pumping stroke of the pump piston 2, the two compression chambers 18, 20 are filled with fuel via the supply line 24. By means of the compression stroke of the pump piston 2, when both valves 25, 26 are closed, the fuel located in the compression chambers 18, 20 is compressed to a higher pressure; the check valves 22, 23 prevent the return flow of compressed fuel back into the supply line 24.

During the compression stroke of the pump piston 2 and with the control chamber 17 pressure-relieved (that is, with the second valve 26 open), the onset of the injection event is initiated by closure of the first valve 25. The higher injection pressure builds up in the first compression chamber 18 and thus in the nozzle chamber 13 as well. As soon as the fuel pressure prevailing in the nozzle chamber 13 suffices to open the valve member 8 under pressure control, counter to the action of the closing spring 10, the fuel is injected into the combustion chamber. If the second valve 26 is now closed as well, then a higher fuel pressure builds up in the second compression chamber 20 and thus in the control chamber 17 as well. The control chamber 17 is no longer pressure-relieved, and so the valve member 8 closes the injection openings 12. Opening the second valve 26 relieves the control chamber 17 of pressure again, and the valve member 8 opens under stroke control, so that a postinjection at the fuel pressure prevailing in the nozzle chamber 13 is performed. If the fuel pressure prevailing in the nozzle chamber 13 no longer suffices to open the valve member 8, then the closing spring 10 closes the valve member 8, and the injection event is ended.

Figure 2:
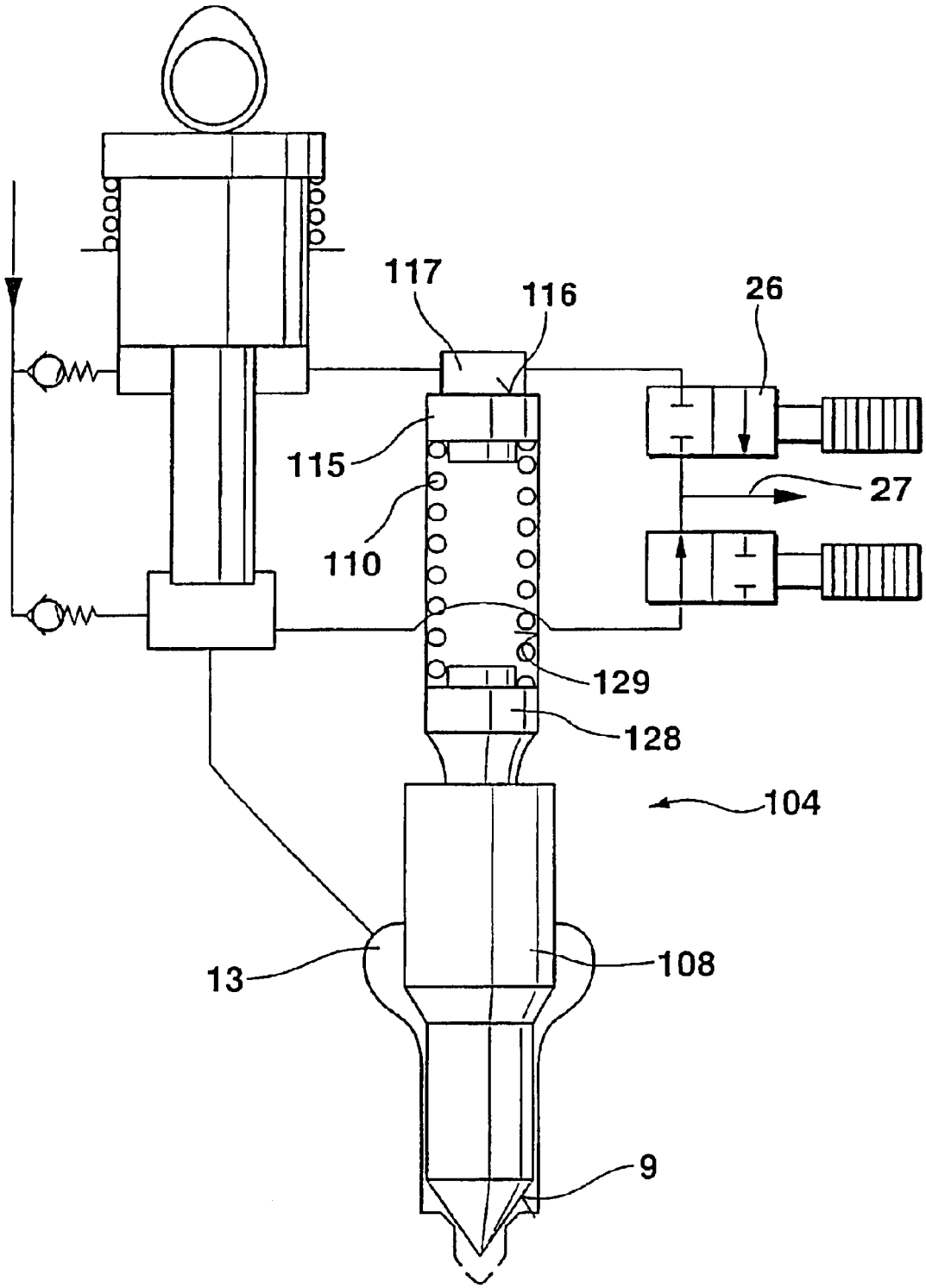
FIG. 2 schematically shows the essential components of a second fuel injection system of the invention, with a graduated pump piston and with a deflection piston acting on the valve member.

The fuel injection system shown in FIG. 2, instead of a closing piston, uses a deflection piston 115, whose face end remote from the valve sealing face 9 forms the second control face 116 and defines the control chamber 117. The closing spring 110 is braced on the end of the deflection piston 115 remote from the second control face 116 and on a head 128 of the valve member 108. The deflection piston 115 and the head 128 are guided displaceably in a common axial guide bore 129 of the injection valve 104.

When the second valve 26 is open, the control chamber 117 is pressure-relieved via the relief line 27, and the deflection piston 115 is displaced into its outermost position in the valve opening direction, so that the fuel pressure prevailing in the nozzle chamber 13 suffices to open the valve member 108 counter to the closing spring 110. When the second valve 26 is closed, the deflection piston 115 is displaced in the valve closing direction by the fuel pressure prevailing in the control chamber 117, and as a result the closing spring 110 is compressed so much that the fuel pressure prevailing in the nozzle chamber 13 no longer suffices to open the valve member 108.

The foregoing relates to preferred exemplary embodiments of the invention, it being understood that other variants and embodiments thereof are possible within the spirit and scope of the invention, the latter being defined by the appended claims.

I claim:

1. In a fuel injection system for internal combustion engines, having a plurality of injection valves (4; 104), each provided in a respective fuel injection line (3), which valves each have one nozzle chamber (13), one control chamber (17; 117), one valve member (8; 108), which controls the injection openings (12) of the nozzle chamber (13) and which is actuatable counter to the action of a closing spring (10; 110) via a first control face (14), located in the nozzle chamber (13) and acting in the valve opening direction, and via a second control face (16; 116), located in the control chamber (17; 117) and acting in the valve closing direction, one piston (2), displaceable in the compression direction, which on its face end defines a first compression chamber (18), communicating with the injection line (3), for generating the injection pressure, one first valve (25) for controlling the pressure buildup in the first compression chamber (18), and one second valve (26) for controlling the pressure buildup in the control chamber (17; 117), the improvement wherein the piston (2) comprises an annular shoulder (19), which defines a second compression chamber (20) communicating with the control chamber (17; 117).

2. The fuel injection system of claim 1, further comprising a closing piston (15) having a face end forming the second control face (16), the closing piston (15) resting at its other end on the valve member (8).

3. The fuel injection system of claim 1, further comprising a deflection piston (115) having a face end (115) forming the second control face (116), the closing spring (110) of the valve member (108) being braced on the other end of the deflection piston (115).

4. The fuel injection system of claim 1, wherein the two compression chambers (18, 20) each communicate via a respective check valve (22, 23) with a fuel supply line (24).

5. The fuel injection system of claim 2, wherein the two compression chambers (18, 20) each communicate via a respective check valve (22, 23) with a fuel supply line (24).

6. The fuel injection system of claim 3, wherein the two compression chambers (18, 20) each communicate via a respective check valve (22, 23) with a fuel supply line (24).

7. The fuel injection system of claim 1, further comprising a cam (5) that drives the piston (2) counter to the action of a restoring spring (6).

8. The fuel injection system of claim 2, further comprising a cam (5) that drives the piston (2) counter to the action of a restoring spring (6).

9. The fuel injection system of claim 3, further comprising a cam (5) that drives the piston (2) counter to the action of a restoring spring (6).

10. The fuel injection system of claim 4, further comprising a cam (5) that drives the piston (2) counter to the action of a restoring spring (6).

11. The fuel injection system of claims 5, further comprising a cam (5) that drives the piston (2) counter to the action of a restoring spring (6).

12. The fuel injection system of claim 6, further comprising a cam (5) that drives the piston (2) counter to the action of a restoring spring (6).

* * * * *